US007971282B2

(12) United States Patent
Berge

(10) Patent No.: US 7,971,282 B2
(45) Date of Patent: Jul. 5, 2011

(54) HELMET EARMUFFS/COVERS

(76) Inventor: Maureen E. Berge, New York, NY (US)

( * ) Notice: Subject to any disclaimer, the term of this patent is extended or adjusted under 35 U.S.C. 154(b) by 1035 days.

(21) Appl. No.: 11/772,938

(22) Filed: Jul. 3, 2007

(65) Prior Publication Data

US 2009/0007318 A1 Jan. 8, 2009

(51) Int. Cl.
*A42B 1/06* (2006.01)

(52) U.S. Cl. ..... 2/423; 2/209; 2/421

(58) Field of Classification Search ..... 2/422, 423, 2/421, 209, 10, 424
See application file for complete search history.

(56) References Cited

U.S. PATENT DOCUMENTS

| | | | | | |
|---|---|---|---|---|---|
| 2,991,478 | A | * | 7/1961 | Zbikowski | 2/421 |
| 3,239,842 | A | * | 3/1966 | Marchello | 2/422 |
| 3,497,874 | A | * | 3/1970 | Molitoris | 2/423 |
| 3,594,815 | A | | 7/1971 | Reese | |
| 3,845,505 | A | | 11/1974 | Davison et al. | |
| 4,670,911 | A | * | 6/1987 | Dunford | 2/209 |
| 5,231,704 | A | * | 8/1993 | Hildenbrand | 2/423 |
| 5,461,730 | A | * | 10/1995 | Carrington | 2/411 |
| 5,477,564 | A | * | 12/1995 | Tichy | 2/423 |
| 5,575,009 | A | * | 11/1996 | Ryvin | 2/173 |
| 5,737,777 | A | * | 4/1998 | Hilleary | 2/421 |
| 6,029,282 | A | * | 2/2000 | Buschman | 2/422 |
| 6,256,799 | B1 | * | 7/2001 | McGlasson et al. | 2/422 |
| 2005/0120467 | A1 | * | 6/2005 | Desarmaux et al. | 2/422 |
| 2006/0212998 | A1 | * | 9/2006 | Gath | 2/423 |

OTHER PUBLICATIONS

International Search Report, PCT/US08/08248, Oct. 3, 2008, 3 pages.
Written Opinion of the International Searching Authority, PCT/US08/08248, Oct. 3, 2008, 5 pages.

* cited by examiner

*Primary Examiner* — Katherine Moran
*Assistant Examiner* — Richale L Quinn

(57) ABSTRACT

Earmuffs for use with protective headgear, primarily helmets for use in outside sports such as bicycling, skiing and the like, wherein the earmuffs are in the form a sleeves with flaps that overlap the edges of the sleeves, include a base element that spans a wearer's head and couples left and right sleeves, and include a chin cover that receives the portion of a chin strap that extends beyond the sleeve.

1 Claim, 8 Drawing Sheets

HELMET EARMUFFS/COVERS

FIELD OF THE INVENTION

The present invention relates generally to wearing apparel and, more specifically, to earmuffs for protecting a wearer's ears from cold, wherein the earmuffs are adapted to be worn with protective headgear such as helmets for use in sports.

BACKGROUND OF THE INVENTION

While participating in sports such as bicycling, skateboarding, ice skating and skiing people wear helmets to protect their heads. Typical helmets are made of a rigid material like polystyrene and may include a plastic or carbon fiber shell. Many helmets, especially those used in bicycling and skateboarding are designed to sit on top of the users head without covering the ears. In order to fix the helmet in position on a user's head, a pair of adjustable straps with clips extends from the lower sides of the helmet around a wearer's chin.

However, many helmets do not cover the ears leaving them susceptible to the cold. This is especially true when people are quickly moving outside in colder environments. In order to solve the problem a person may wear earmuffs under the helmet, but some people find this is uncomfortable. A bulky band connecting the pods of the earmuffs causes the helmet to incorrectly fit the wearer's head. Moreover, an uncomfortable helmet may distract the wearer from concentrating on the sporting activity resulting in poor performance. It is desirable to eliminate the band under the helmet so that the helmet comfortably and accurately fits the head of the wearer.

Helmets have been designed to include a protective cover where the shell of the helmet extends over the ears of the wearer, however, such helmets are problematic in that the shell is rigid and there is little ability to adjust to changing weather conditions and temperatures throughout the day. As the day becomes hotter, there is no ability to remove the protective ear shell portion of the rigid helmet without completely taking off the helmet and losing the protective covering altogether. Furthermore, there is little ability to adjust to the changing temperature of the helmet wearer as the wearer warms up during exercise. For example, a warmed up skier may become uncomfortably warm in the rigid helmet and forced to remove the helmet completely to cool off.

Some helmets like the Giro brand ski/snowboard helmets have removable pads that attach to the side of the helmet and are disposed on the inner side of the strap. Such pads may also be fixedly attached to the helmet strap by passing through a lower loop near the chin of the wearer. However, these pads are problematic in that they are specifically sized and shaped in order to precisely match the helmet configuration. These are not easily interchangeable between different helmet types, styles, brands, and configurations. This is problematic when a helmet user grows into a larger helmet, and larger corresponding pads must be obtained in order to fit the larger helmet. Additionally, if the helmet user purchases a second helmet or upgrades helmets by changes style or brand type, the ear pads are not easily interchangeable between helmets.

Another solution, identified in U.S. Pat. No. 5,231,704, is to provide a covering member in the shape of a truncated cone or triangle that receives the loose end of a chinstrap and comprises coupling means located on each opposing interior side of the covering member that couple together above the point in which front and rear chinstraps are joined together.

What is needed is a helmet earmuff that eliminates the band under the helmet so that the helmet comfortably and accurately fits the head of the wearer, an earmuff which is removable and adjustable from a helmet over the course of its use, an earmuff which is easily interchangeable between helmet sizes, styles, brands, and configurations, an earmuff with improved ability to secure the earmuff to the helmet straps, an earmuff that improves the comfort to the wearer along the entire length of the straps, and an earmuff that provides protection from heat loss about the lower head/neck portion of the wearer and/or the crown of the wearer.

SUMMARY OF THE INVENTION

It is the object of the present invention to provide a helmet with earmuffs that accurately fits a wearer's head.

It is the object of the present invention to provide a helmet with earmuffs that comfortably fits a wearer's head while covering the wearer's earlobes for warmth.

It is the object of the present invention to provide earmuffs which are an after market product easily interchangeable between helmet sizes, styles, brands, and/or configurations.

These and other objectives of the present invention are met by providing helmet earmuffs that cover the ears of a wearer and extend down the sides of the wearer's face. Each earmuff comprises a sleeve that comes into contact with the wearer's head and receives a chinstrap extending from the base of a helmet. The chinstrap is fed into an upper edge of the sleeve positioned next to the helmet and fed through a lower edge of the sleeve extending away from the upper edge. The earmuff further comprises a first side that comes into contact with the wearer's head and a second side that is exterior to the first side so that the first side is positioned between the second side and the wearer's head. The upper edge of the sleeve can be wide and the lower edge narrow such that the sleeve tapers from the upper edge to the lower edge. A sleeve can be secured to a chinstrap utilizing an elastic element that is threaded through the lower edge of a sleeve.

The earmuff can further be secured with a flap coupled to one side of the sleeve. The flap overlaps an edge of the sleeve and fastens to another side of the sleeve. With such a feature, it is beneficial if the flap is sized to span the inner width that separates a front strap and a back strap for each side of a helmet. The flap can be fastened to the second side using a Velcro® brand fastener. In one embodiment the flap is coupled to the first side of the sleeve and overlaps the upper edge of the sleeve.

The earmuffs also can comprise left and right sleeves that receive left and right chinstraps respectively and a base element that is coupled to the left and right sleeves and spans the wearer's head such that the left and right sleeves are positioned about the left and right sides of a wearer's head so as to enable one side of each sleeve to cover the left and right ears. The base element can be a cap that fits the contour of the wearer's head and a neckband with left and right portion coupled to the left and right sleeves. The cap can be domed shaped so as to fit to the size of the wearer's head. The neckband can have an upper portion coupled to upper edges of the left and right sleeves and a lower portion coupled to lower edges of the left and right sleeves. Further, the neckband can conform to the contour of the back of a wearer's head and neck.

Another aspect of the invention is for straps to extend from the lower edges of left and right sleeves and be able to fasten together below the wearer's chin.

Yet another aspect of the invention is to provide for a chin cover that receives a portion of a chinstrap that extends beyond the lower edge of a sleeve so as to provide comfort to the wearer. One end of the chin cover can be coupled to the lower edge of the sleeve. The other end of the chin cover can be fastened to the lower edge of the opposing sleeve. Optionally, the chin cover may be of a predetermined over lapping (female/male) shape to provide easy access to the grommet or strap clips.

Preferably, the earmuff is of a predetermined size suitable for use with all adult sized heads. Child size earmuffs are available in smaller predetermined shapes and sizes. Preferably, the earmuffs have reversible sides made out of different materials, such as cotton, plastic, polyester, Gortex® brand material, woven fabrics and combinations thereof. Optionally, a first side is made out of a breathable material, and a second side is made out of non-breathable material. Optionally, the earmuffs can utilize microfibers that are light weight and water resistant.

BRIEF DESCRIPTION OF THE DRAWINGS

FIG. 3(*b*) shows a back view of the earmuff of FIG. 3(*a*).

FIG. 5(*b*) shows earmuff device of FIG. 5(*a*) with straps and clip.

DETAILED DESCRIPTION OF THE INVENTION

Figure 1:
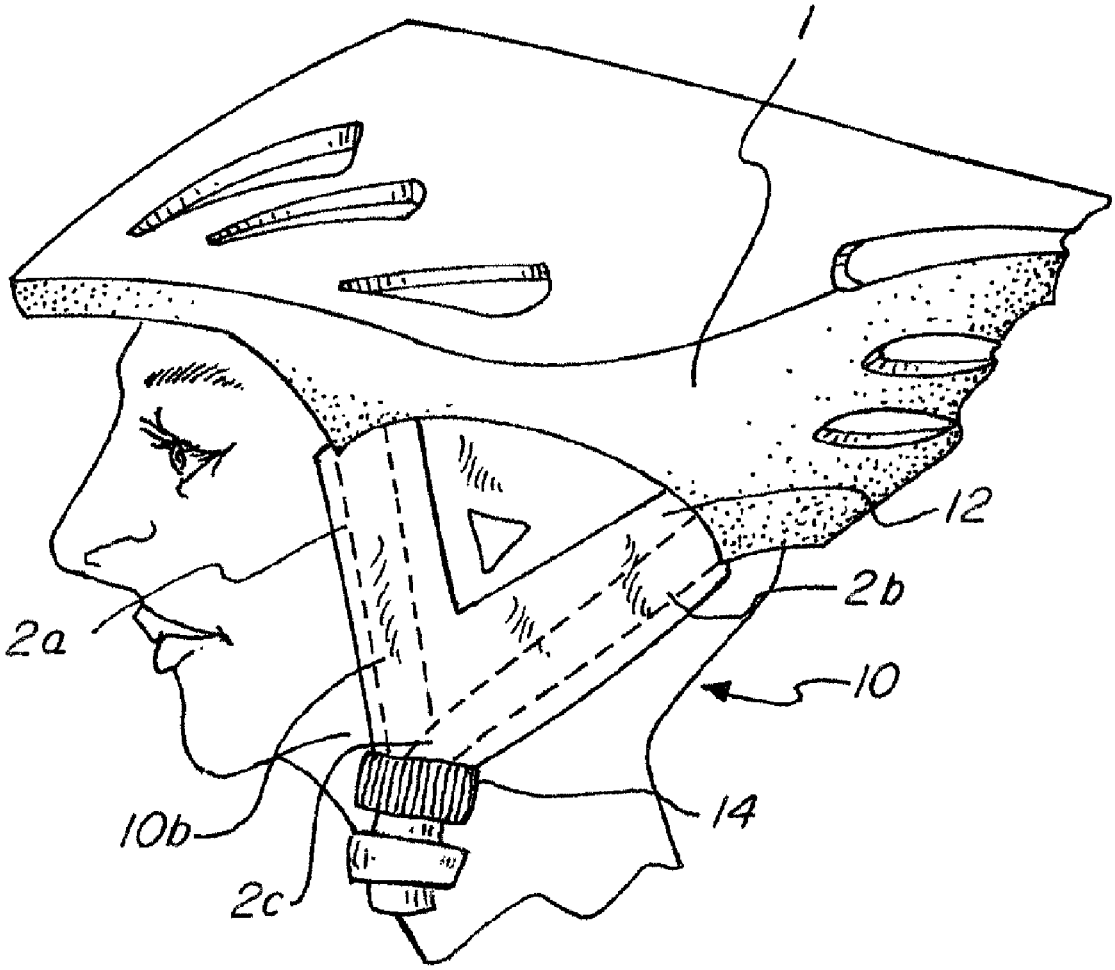
FIG. 1 shows bicycle helmet with the earmuff of the present invention in place, on the left side of a head.

Referring now to FIG. 1, an earmuff of the present invention is shown positioned on a bicycle helmet strap. One earmuff is shown covering the left ear of the wearer. Earmuff 10 may be triangularly shaped and positioned over and fastened to the strap of the helmet. Earmuff 10 is sized to cover the ear and face of the wearer to provide warmth during outside activities. Earmuff 10 is a sleeve and has a first side (not shown in FIG. 1) and a second side 10*b* with a wide upper edge 12*b* and a narrow lower edge 14*b*. The first side comes into contact with the wearer's head and the second side 10*b* is exterior to the first side. The wide upper edge 12*b* is positioned in the region associated with the lower part of helmet 1. The width of upper edge 12*b* corresponds to the spacing of the outermost peripheral elements of the forward helmet strap 2*a* and the aft helmet strap 2*b* in the region adjacent to helmet 1. The second side 10*b* extends away from the upper edge 12*b* and tapers to the narrow lower edge 14*b*. The width of lower edge 14*b* corresponds to the spacing of the forward helmet strap 2*a* and the aft helmet strap 2*b* approximate to the region where these elements come together. As such, the width of the second side 10*b* may correspond to width of the straps 2*a* and 2*b* in a region where they are still independent or in the lower region where the straps become coupled or an integrated element 2*c*. Overall the width of second side 10*b* follows the contour of the outer width of straps 2*a* and 2*b*.

Figure 2:
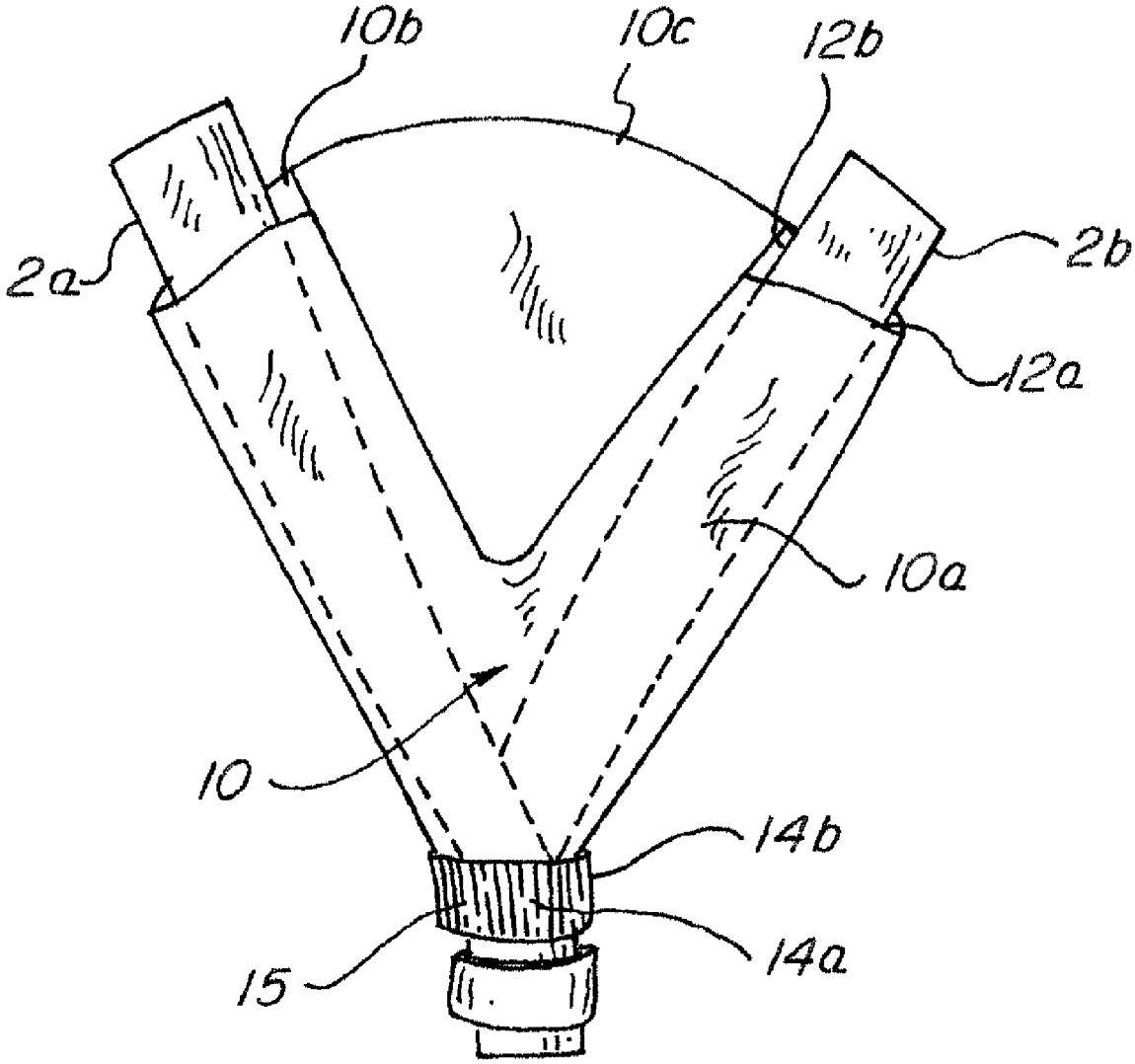
FIG. 2 is a front side view of the earmuff of FIG. 1.

FIG. 2 shows earmuff 10 positioned about straps 2*a* and 2*b*. Earmuff 10 has a first side 10*a*, a second side 10*b*, and a flap 10*c*. The first 10*a* and second 10*b* sides form a sleeve like structure into which helmet straps 2*a* and 2*b* are inserted. Both the first 10*a* and second 10*b* sides have wide upper edges 12*a* and 12*b* and narrow lower edges 14*a* and 14*b*. It is beneficial if the first 10*a* and second 10*b* sides are securely coupled to one another such that they form an integrated unit. Alternatively, they can be of unibody construction. The earmuff also contains an elastic element 15 that is integrated into or coupled to the lower edges 14*a* and 14*b*. This elastic element 15 crimps the earmuff 10 against the straps 2*a*, 2*b* and assists in securing the earmuff 10 to the straps 2*a*, 2*b*. Earmuff 10 also contains a flap 10*c*. Flap 10*c* is fixedly coupled to the upper edge 12*a* of first side 10*a*. The flap 10*c* is wide in the region corresponding to the upper edge 12*a* and tapers to form a triangular shape. The width of the flap 10*c* in the region of upper edge 12*a* corresponds to the inner spacing that separates straps 2*a* and 2*b*. The flap 10*c* is intended to overlap the second side 10*b* such that a portion of the second side 10*b* is sandwiched between the flap 10*c* and the first side 10*a*. The flap 10*c* also contains a fastening element (not shown) on the inner face of the flap 10*c*. This fastening element enables the flap 10*c* to be secured to the outer face of second side 10*b*. The fastening element can utilize a Velcro® brand fastener.

The earmuff 10 is placed on to the helmet straps 2*a* and 2*b* by feeding these straps into the opening formed by the upper edges 12*a*, 12*b* of earmuff 10 and through the opening formed by the lower edges 4*a*, 4*b* of earmuff 10. The elastic element 15 secures the lower portion of earmuff 10 to straps 2*a* and 2*b*. Earmuff 10 is further secured to straps 2*a* and 2*b* by flap 10*c* over lapping the upper edge 12*b* of second side 10*b*. Earmuff 10 is fastened to second side 10*b* utilize a fastening element such as a Velcro® brand fastener.

Figure 3A:
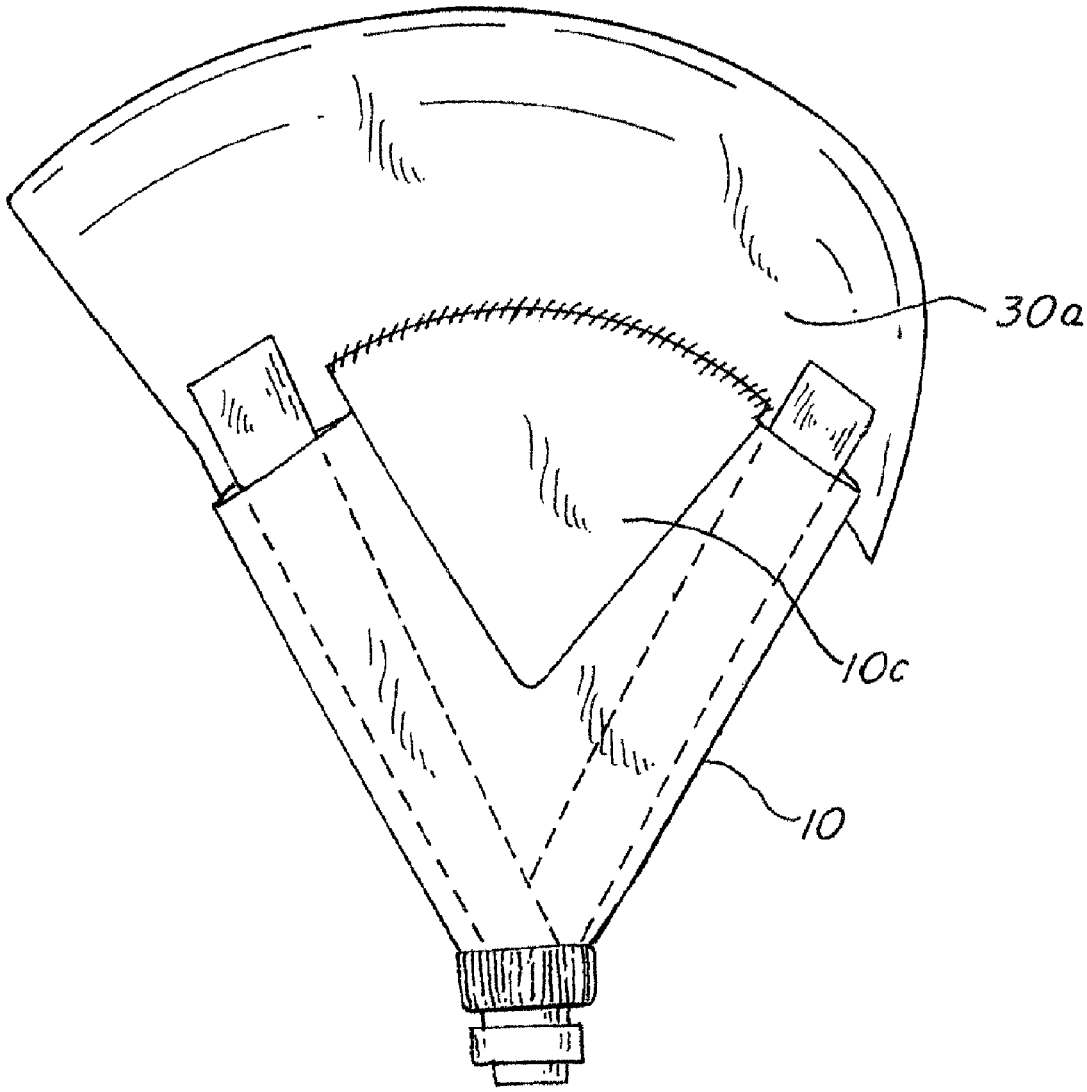
FIG. 3(*a*) shows a side view of an earmuff attached to a cap.
Figure 3B:
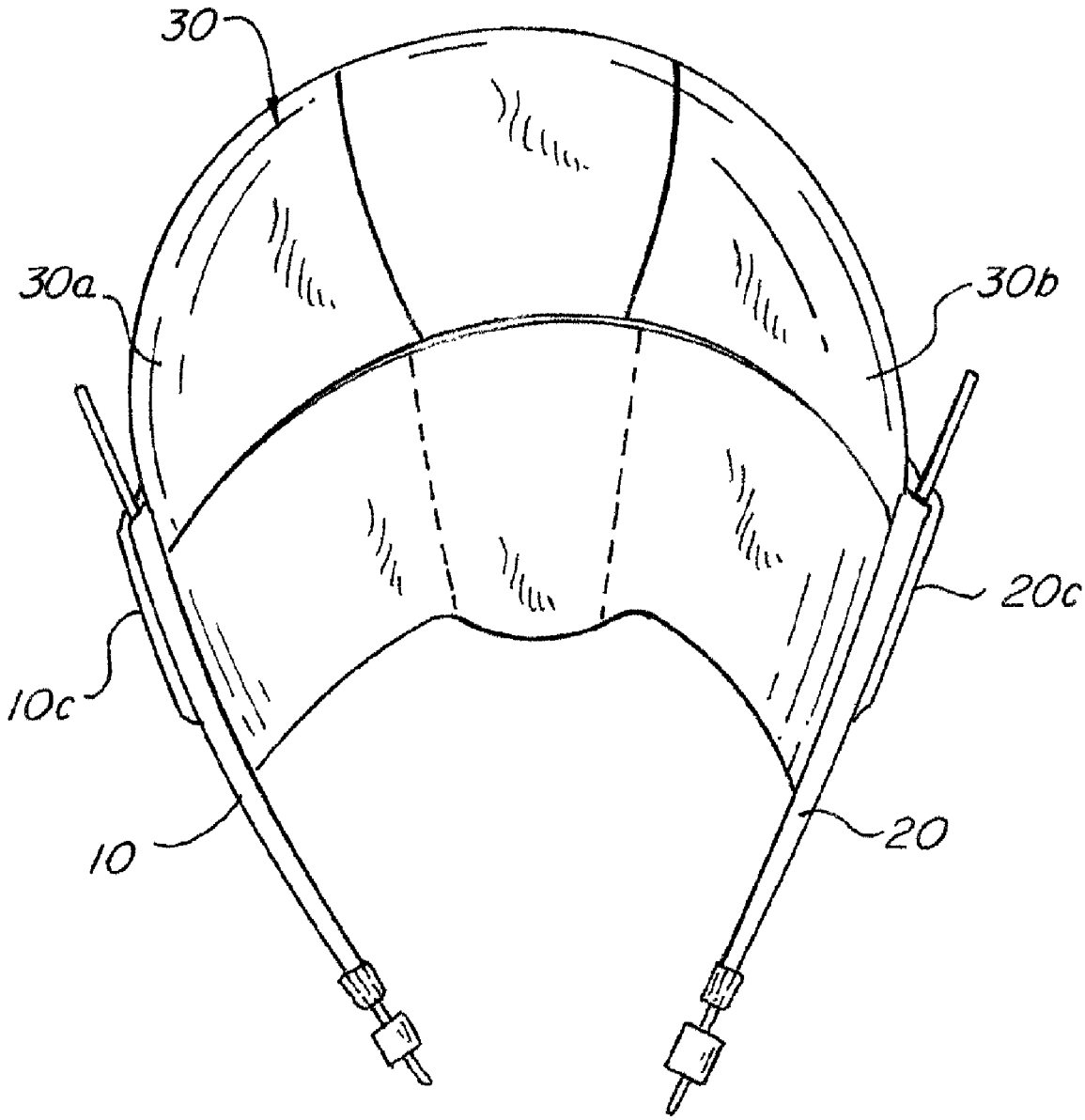

FIGS. 3*a* and 3*b* depict left 10 and right 20 earmuffs that utilize a first side 30 that serves as a common base element to both earmuffs 10, 20. This first side 30 spans from the left earmuff 10 to the right earmuff 20 and is shaped as a cap that fits the contour of the wearer's head. Such a first side 30 can be designed to follow the upper contour of the wearer's head and/or rearward contour of the wearer's head. Such a design depends on considerations of comfort and flexibility. FIGS. 3*a* and 3*b* depict first side 30 as a cap that fits the contour of both the upper and rearward portions of a wearer's head. Flaps 10*c* and 20*c* are positioned along a mid point of left and right sides 30*a*, 30*b* of first side 30 and coupled to these sides. This position corresponds to the location of upper edges 12*b* and 22*b* of second sides 10*b* and 20*b*. Such a position should be selected such that the flaps 10*c*, 20*c* are sufficiently coupled to second sides 10*b*, 20*b* so as to secure the earmuffs 10, 20 to the helmet straps.

Figure 4:
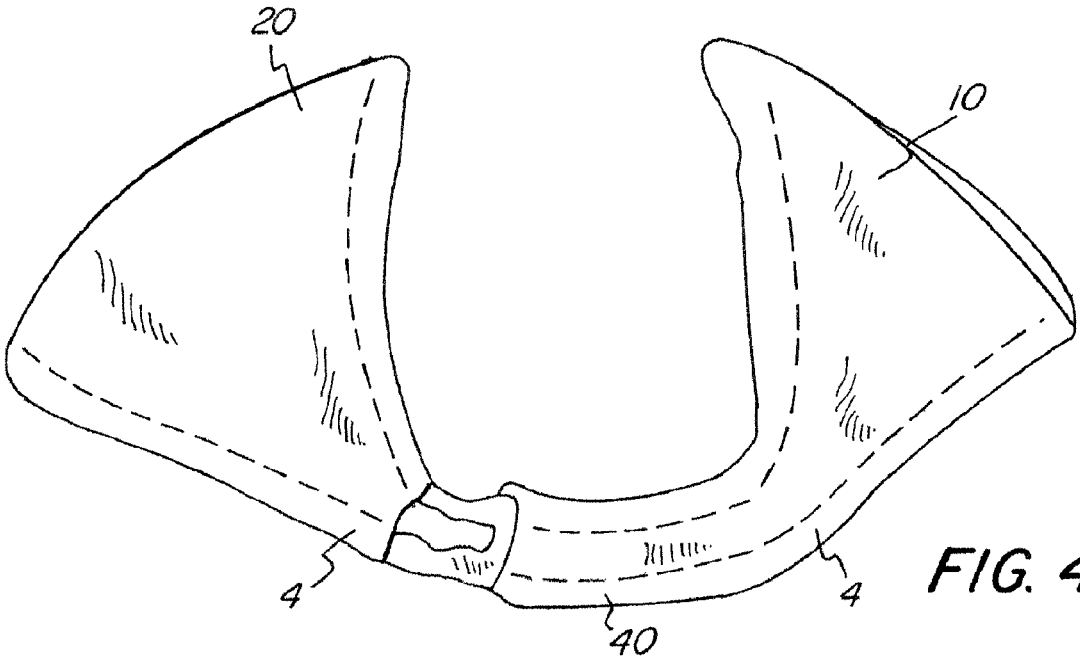
FIG. 4 is a front view of interconnected earmuffs of FIG. 2 with overlapping chin portion and strap.

FIG. 4 shows earmuff 10 incorporating an overlapping chin portion 40. Overlapping chin extension 40 is included to allow the wearer to have a portion earmuff 10 extend toward earmuff 20 about the region in which opposing helmet straps are coupled together. Such extension may be used to couple earmuff 10 to earmuff 20. By having an extended portion to earmuff 10 and possibly attaching the two earmuffs, the wearer is able to adjust the earmuffs to conform to wearers face, thus ensuring a snug fit and provide further comfort to the wearer. In addition, overlapping chin extension 32 prevents flapping of earmuffs when the wearer is in motion. For example, a bicyclist pedaling into the wind will have air flowing over the face and through the helmet which may cause earmuffs to flutter or flap. Flapping can be reduced or eliminated by connecting overlapping chin extension 40 of earmuff 10 to earmuff 20. The overlapping extension 40 of earmuff 10 may be attached to overlapping portion of earmuff 20 by any fastener such a Velcro® brand fastener, string, lace, pin, or clip.

Figure 5A:
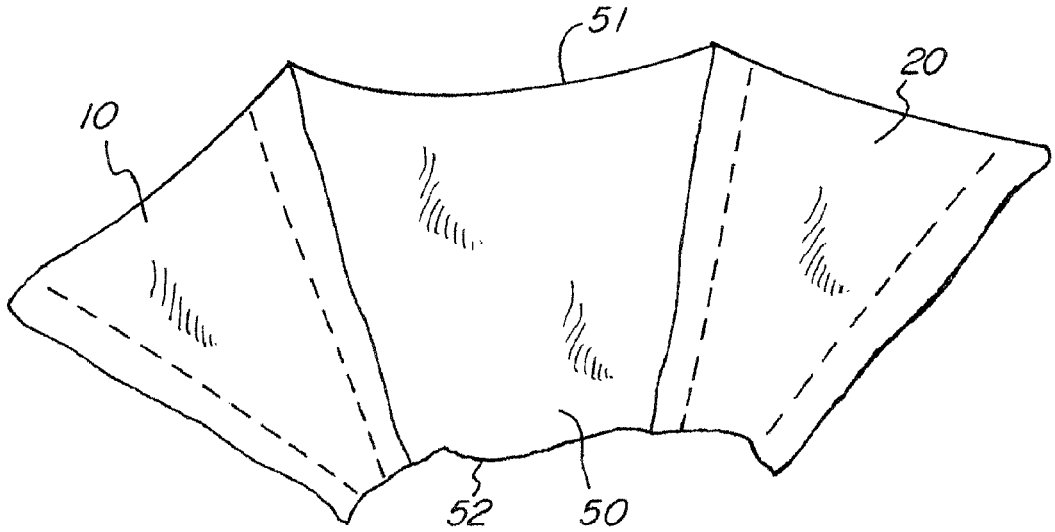
FIG. 5(*a*) shows interconnected earmuff device with scarf.
Figure 5B:
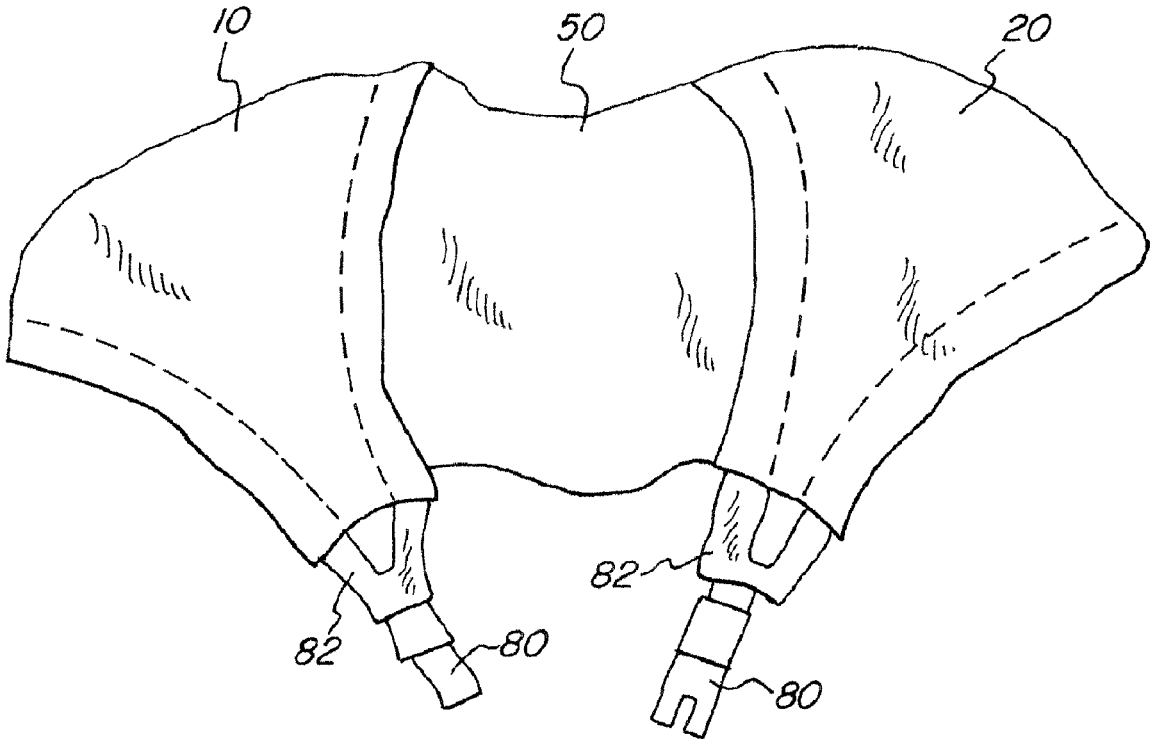

FIG. 5(*a*) depicts earmuffs 10 and 20 that are coupled via a neck band 50. Neck band 50 may be made out of any suitable material for interconnected earmuff 10 and earmuff 20 such as manufactured fiber, wool, cotton, nylon, polyester, plastic, thermoplastic, Gortex® brand material, woven fabrics and combinations thereof. Neck band 50 is preferably made out of a stretchy material such as Lycra® brand manufactured fiber. Neck band 50 warms a wearer neck and ensures that earmuffs 10 and 20 provide a snug fit and further secure the earmuffs to the helmet straps. Neck band 50 comprises upper edge 51 and lower edge 52. Upper edge 51 is typically longer than lower edge 52 in order to correspond to the dimensions of a wearer's head and traverse the distance around a wearer's head. Lower edge 52 is typically shorter than edge 51 for it typically traverses the distance around a user's neck. Accordingly, neck band 50 is tapered such that it's width becomes more narrow from upper edge 51 to lower edge 52. Neck band 50 is tapered to promote a snug, level, and stable fit of helmet to wearer's head.

Referring to FIG. 5(*b*) the interconnected earmuff device of FIG. 5(*a*) is shown. Interconnected earmuff device comprises clips 80 extending from the bottom edges 4 of earmuff 10 and earmuff 20. Clips 80 are connected to strap 82 which is fixedly attached to earmuff 10 and earmuff 20. Clips 80 may be made of plastic and are adjustable in relation to strap 82 to ensure the proper fit of the helmet.

Helmets come in a variety of sizes, and it is well known that a helmet should be selected to correctly fit a wearer's head. A correct fit typically is achieved where a helmet is snug, level, and stable in relation to the wearer's head. The dimensions of an earmuff, including the length, width, height, and proportions of the device are predetermined in order to ensure that the size of the earmuff device does not interfere with the correct fit of the helmet, while maintaining a snug earmuff fit in relation to the wearer's head. A child size earmuff can be given predetermined dimensions selected to correctly fit a head having a circumference of between about 460 to 530 mm, i.e. a smaller head such as that of a child.

Figure 6:
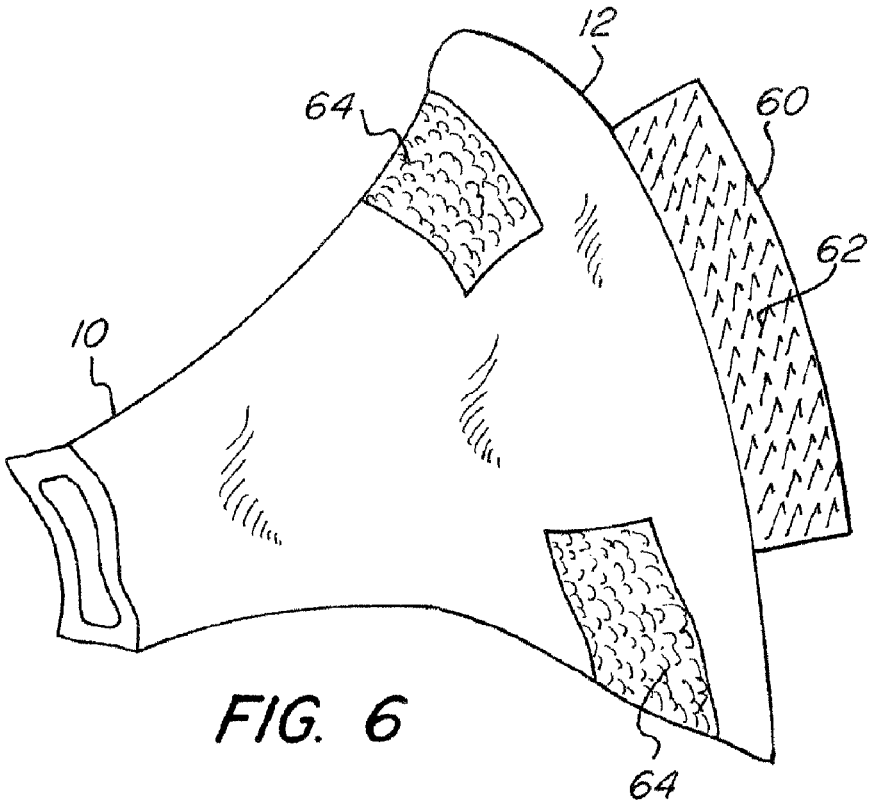
FIG. 6 shows a side view of an earmuff with a fastener on a top edge.
Figure 7:
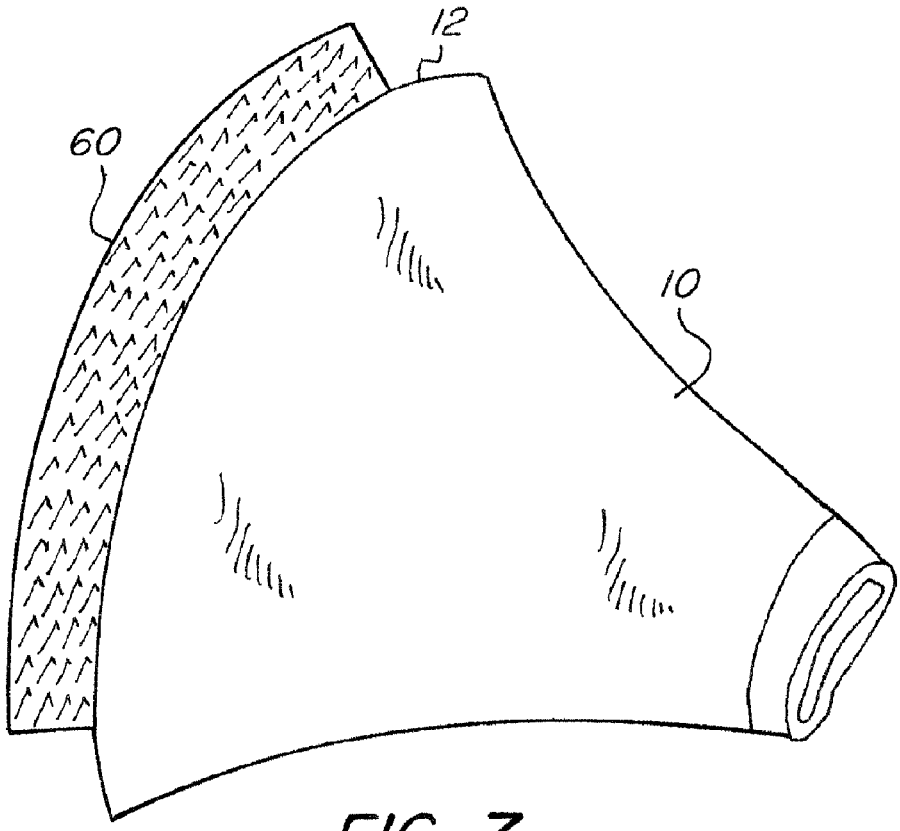
FIG. 7 shows a right side view of earmuff of FIG. 6.
Figure 8:
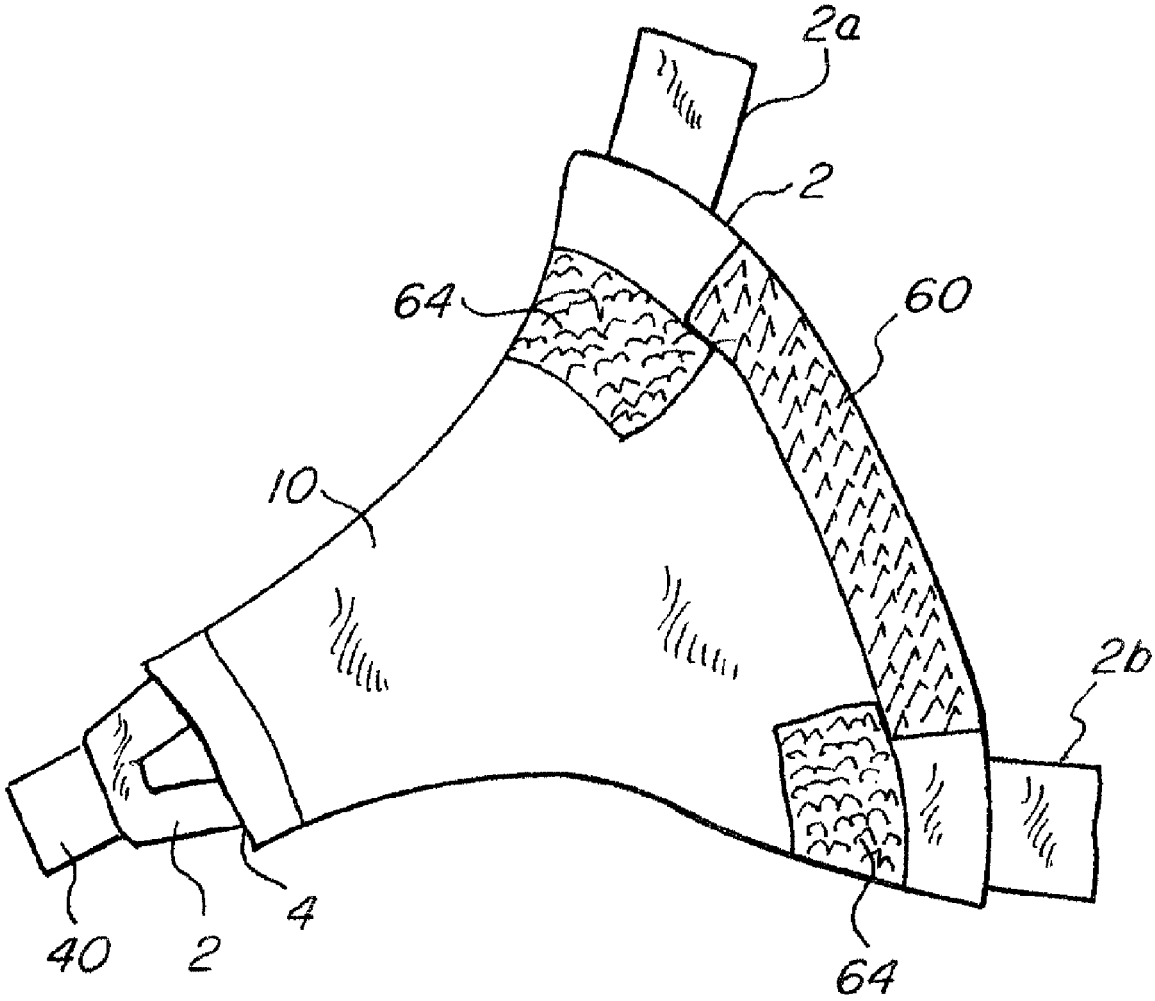
FIG. 8 is a left side view of the earmuff of FIG. 7 with straps.

Referring to FIGS. 6-8 an earmuff of FIG. 2 is shown with flap 60. Flap 60 is shown extending from top edge 12 and running along the length of top edge 12. Flap 60 may be made of hook and loop type fastener such as Velcro® brand fastener having a hook portion 62 and that fastens to fiber portion 64. Contacting hook portion 62 with fiber portion 64 creates tack and compresses the front and back sides of earmuff 10 closer to one another. FIG. 9 shows flap 60 folded such that hook portion 62 is in contact with fiber portion 64. Flap 60 holds first strap 2*a* and second strap 2*b* towards the outside edge of earmuff 10. Flap 60 may also be of a predetermined shape suitable for fixedly attaching earmuff 10 to strap (not shown). By using a hook and loop fastener, the wearer has the option of adjusting the connection over the length of fiber portion 64 to create a tighter or looser fit. Referring now to FIG. 7 a right side view of earmuff of FIG. 6 is shown. Here, on the back side Flap 60 is attached to the top edge 12 of earmuff 10. Fiber portion 64 is not visible from this view, for it is located on the opposite side of the earmuff.

Although the invention has been described with reference to a particular arrangement of layers and elements, and materials used, these are not intended to exhaust all possible arrangements and materials, and indeed many modifications and variations will be ascertainable to those of skill in the art.

What is claimed is:

1. An earmuff that protects a wearer of a helmet with chinstraps, comprising:

a sleeve that comes into contact with the wearer's head and receives at least one chinstrap from at least one side of the helmet; and a flap coupled to one side of the sleeve;

wherein the flap overlaps an edge of the sleeve and fastens to another side of the sleeve so as to secure the earmuff to the at least one chinstrap;

wherein the sleeve covers the wearer's ear;

wherein the sleeve comprises a first side and a second side such that the chinstrap is fed through a cavity between the first and second sides and the first side is positioned between the wearer's head and the second side; and wherein the flap is coupled to the first side and fastens to the second side.

* * * * *